United States Patent [19]

Eckman

[11] 4,306,883

[45] Dec. 22, 1981

[54] PROCESS FOR FORMING COAL-OIL MIXTURES UNDER SELECTED CONDITIONS OF TEMPERATURE AND SHEAR

[75] Inventor: Carl E. Eckman, Swarthmore, Pa.

[73] Assignee: Gulf & Western Manufacturing Company, Swarthmore, Pa.

[21] Appl. No.: 230,064

[22] Filed: Jan. 29, 1981

[51] Int. Cl.[3] ..... C10L 1/32; C10L 1/18

[52] U.S. Cl. ..... 44/51; 44/1 R; 44/62; 44/66; 44/68; 44/77

[58] Field of Search ..... 44/51, 1 R, 66, 62, 44/68, 77

[56] References Cited

U.S. PATENT DOCUMENTS

| | | | |
|---|---|---|---|
| 3,401,049 | 9/1968 | Horowitz | 44/1 R |
| 3,698,931 | 10/1972 | Horowitz | 44/1 R |
| 4,033,852 | 7/1977 | Horowitz et al. | 44/1 R |
| 4,101,293 | 7/1978 | Krause et al. | 44/51 |
| 4,252,639 | 2/1981 | Smith et al. | 209/5 |

*Primary Examiner*—Jacqueline V. Howard

*Attorney, Agent, or Firm*—Bartholomew Verdirame; Thomas E. Harrison, Jr.

[57] ABSTRACT

An improved technique is provided for forming coal into a stabilized coal-oil mixture. Coal, in a fine mesh size, is admixed with oil, a monomeric compound, a reaction initiator and a reaction catalyst at elevated temperatures and under a condition of low shear. The coal mixture is thereafter immediately subjected to a condition of high shear at the maintained elevated temperature. The mixture is then admixed with a gelling agent to form a stable coal-oil mixture. According to the technique, coal of significantly greater water content than heretofore thought acceptable, is formed to a stable coal-oil mixture in a ready manner. In addition, the amount of monomeric compound heretofore thought needed to form the desired stable mixture is substantially reduced, resulting in improved process efficiency.

In its preferred aspect, the process is adapted to treat raw coal which has first been subjected to pulverization, chemical surface treatment, separation from ash and sulfur, and drying. The raw coal thus processed is thereafter formed into the coal-oil mixture in the form of a stable mixture using the described technique.

27 Claims, 3 Drawing Figures

PROCESS FOR FORMING COAL-OIL MIXTURES UNDER SELECTED CONDITIONS OF TEMPERATURE AND SHEAR

FIELD OF THE INVENTION

The present invention relates to a method for forming stabilized coal-oil mixtures.

In a more specific aspect, this invention relates to an improved method for forming coal-oil mixtures in stable form using selected conditions of elevated temperature and shear or high mixing Still more specifically, this invention is directed to an improvement in a process for forming coal-oil mixtures wherein coal of significantly greater water content than heretofore thought acceptable is utilized to form coal-oil mixtures and wherein the amount of additives used to form the coal-oil mixture in the form of a gel is substantially reduced.

BACKGROUND OF THE INVENTION

Coal is a most valuable form of energy. It is estimated that in the United States there is more energy available in coal than in petroleum, natural gas, oil shale, and tar sands combined. Recent energy shortages, together with the availability of abundant coal reserves and the continuing uncertainties in the availability of crude oil, have made it imperative that methods for converting coal into a more useful energy source be developed.

A number of methods are being explored for this purpose. One such method employs gasification techniques, such as destructive distillation, to effect the conversion of coal to a low or medium Btu gas. In another method, high pressure hydrogenation is utilized to liquefy the coal, making it more suitable for transport and burning. In still another more recently developed technique, termed the "chemical surface treatment" method, raw coal is pulverized to a fine mesh size and is chemically treated to treat the surface of the coal with a monomeric compound in the presence of chemical initiators and catalyst. According to the "chemical surface treatment" method the treated coal is then immediately separated from ash and sulfur and cleaned coal is recovered or, alternatively, formed into a liquid mixture, such as a coal-oil mixture. The coal-oil mixture is thereafter treated with additional materials and a stabilizing agent to form a gel or thixotropic mixture, thereby providing a clean or relatively clean stable composition ready for transport, storage, burning or further processing.

Among the many advantages of the chemical surface treatment method are that severe process conditions of, e.g., temperature and pressure, are avoided. In addition, the method achieves high separations of ash and sulfur using cleaning water, without significantly reducing the Btu value of the coal, a problem usually encountered when cleaning fine size coal with cleaning water, that is, the loss of coal in the cleaning water and the retention of water in the product coal. As a further advantage, the process is readily adapted for use at locations near or at the mine site, making it particularly suitable for reducing the transportation difficulties normally associated with coal processing.

In U.S. patent applications Ser. Nos. 114,357 and 114,414, each filed Jan. 22, 1980, and in U.S. Government Report No. 2694 titled "Fuel Extension by Dispersion of Clean Coal in Fuel Oil", all incorporated herein by reference, the above-described chemical surface treatment technique is disclosed for forming coal into a coal-oil mixture. In summary, according to the chemical treatment method, coal is first cleaned of rock and the like and pulverized to a fine size of about 48 to 300 mesh. The pulverized coal, now in the form of a water slurry, is then treated with a monomeric compound, usually in the presence of a liquid organic carrier, a reaction initiator and a reaction catalyst. The chemical treatment of the coal is adapted to make the coal both hydrophobic and oleophilic. Coal particles so treated are readily separated from unwanted ash and sulfur using oil and water separation techniques. The coal, which is now substantially cleaned of ash and sulfur, is then dried to a water content level suitable for further processing or recovery. The dried coal is thereafter formed into a coal-oil mixture, where it is again subjected to a chemical surface treatment using additional additives. The coal-oil mixture is thereafter treated with a gelling agent to form the coal-oil mixture in the form a stable gel or thixotropic mixture.

The coal-oil mixture product thus produced is advantageously non-settling and enjoys a dispersion stability normally difficult to achieve and maintain without frequent stirring, the addition of further additives or an inordinate amount of fine grinding. In addition, the mixture thus formed is thixotropic, allowing for ready pumpability on subjection to shearing or pumping forces.

It will be seen that the chemical surface treatment technique offers considerable advantages in providing coal as a useful energy source. Although the technique is attractive, however, it would be highly desirable that improvements be developed to make the process even more advantageous. For example, it would be highly desirable that the amount of drying which the cleaned coal is subjected to prior to forming the coal-oil mixture could be reduced, without adversely affecting the gel forming process. Such a decrease in drying would significantly improve the overall efficiency of the process, and advantageously would reduce or eliminate the need for burdensome and expensive drying equipment, such as large scale thermal dryers. Thermal drying equipment, e.g., is both unduly expensive and time consuming for large scale coal operations. The need for its use could seriously detract from the attractiveness of the process.

It would also be highly desirable to reduce the amount of monomeric compound utilized to form the coal-oil mixture. A reduction of this reactant would minimize the amounts of processing equipment and treatment time needed and would also reduce the need for undue amounts of raw materials other than coal, making the process even more attractive.

Accordingly, it is an object of the present invention to provide stable coal-oil mixtures and methods for forming coal-oil mixtures.

It is another object of the invention to provide a method for forming coal-oil mixtures in gel or thixotropic form, using coal of high water content.

It is still another object of the invention to provide a method for forming coal-oil mixtures in gel or thixotropic form, using lesser amounts of gelling agents than heretofore thought necessary to form stable mixtures.

Another object of the present invention is to provide a technique for forming stable coal-oil mixtures using coal of high water content, less drying and less reactant materials, which technique would be readily integrated into an overall process for converting raw coal into a stable coal-oil mixture.

These and other objects will become apparent from the following summary of the invention, taken in conjunction with the accompanying detailed description and drawing figures.

SUMMARY OF THE INVENTION

It has now been surprisingly discovered that stable coal-oil mixtures can be formed from high water content coal using less reactant materials, by employing the chemical surface treatment technique and selected conditions of elevated temperature and shear. In accordance with the process of the invention, coal is admixed with oil, monomeric compound, reaction initiator and reaction catalyst, at conditions of elevated temperature i.e., a temperature in excess of that heretofore considered desirable, and low shear. The mixture is thereafter immediately subjected to a condition of high shear at the same or nearly the same elevated temperature. The coal-oil mixture is thereafter treated with a gelling agent to form a stable coal-oil mixture in the form of a gel or thixotropic mixture.

While it is not clearly understood at this time why the above-described advantageous results are obtained, it is believed that these results may be attributable to the emulsion formed by homogenizing water, normally present in the mixture, into the oil phase. While not intended to be limited by any theory, it is believed that the procedure of the invention achieves stability by facilitating the reaction between monomeric compound and gelling agent due, in part, to the homogenation of monomeric compound from the water phase, thus permitting the presence of greater amounts of water and less monomeric compound.

In accordance with the invention, the condition of low shear is similar or nearly similar to conditions generally employed to slowly admix reactants under low speed stirring. The shearing rate for such admixing is preferably less than about 1000 reciprocal seconds. The condition of high shear, requires the vigorous admixture or turbulence of materials such as in a high speed mixer or other device adapted to impart high shear mixing or agitation. Preferably, the condition of high shear exceeds about 1000 reciprocal seconds. The elevated tempertures employed in the process range from about 145° to 195° F. and is most preferably from about 175° to 190° F.

The time for mixing at the low shear conditions ranges from about 10 to 120, preferably about 30 to 60 seconds, and the time for mixing at the high shear condition ranges, from about 30 to 120, preferably about 60 to 90 seconds, although shorter times are contemplated for steady state operations.

The monomeric compounds employed in the process, include unsaturated organic compounds such as ethylene, propylene, butylene, butadiene, styrene and the like as well as unsaturated carboxylic acids and esters or salts thereof. Reaction initiators that can be used include the free radical initiators such as water soluble salts, like copper nitrate or silver nitrate. Suitable catalysts include the peroxides, such as hydrogen peroxide. The liquid organic carriers that can be used in forming the coal-oil mixtures include commonly available organic fuel oils, such as number 2 or number 6 fuel oil. Gelling agents utilized to stabilize the coal-oil mixture are bases and include the hydroxides, such as sodium hydroxide, calcium hydroxide and the like.

In a more specific aspect, the process of the invention is utilized to convert raw coal into coal-oil mixtures, using an initial pulverization step, a chemical surface treatment and separation step, and a drying step, to treat the raw coal prior to the formation of the coal-oil mixture.

DETAILED DESCRIPTION OF THE INVENTION

Figure 1:
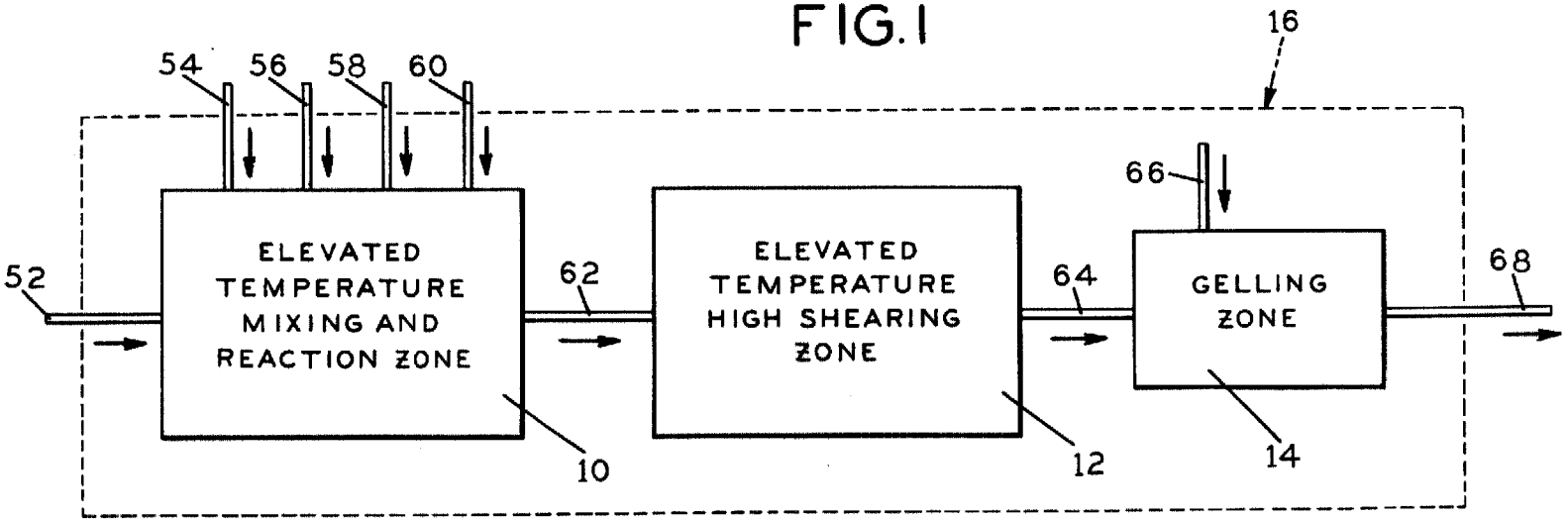
FIG. 1 is a block diagram which generaly illustrates the treatment zones for forming a stable coal-oil mixture in accordance with the invention.
Figure 2:
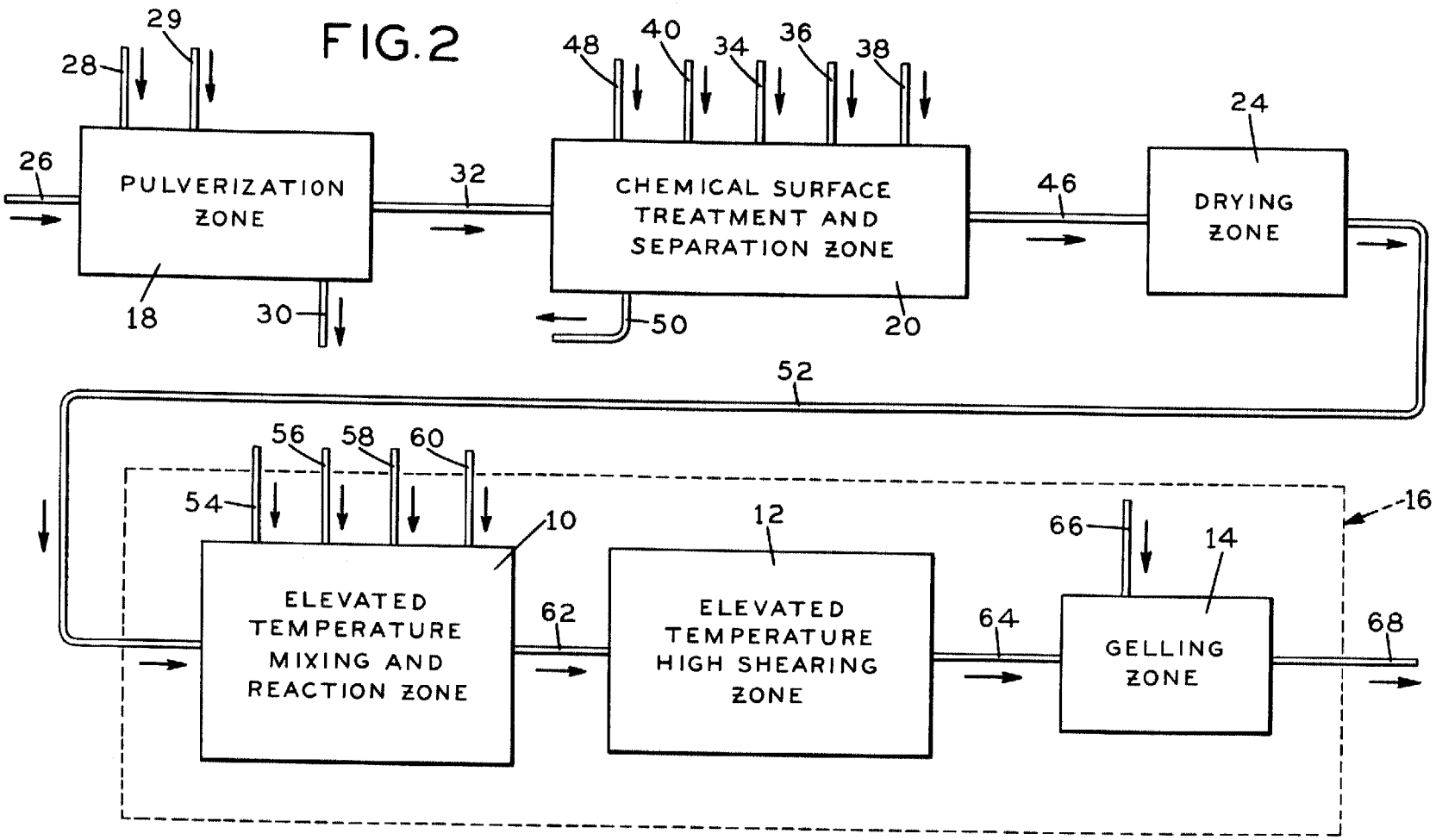
FIG. 2 is a block diagram which generally illustrates the treatment zones for forming a stable coal-oil mixture in accordance with the invention beginning with raw coal.

As shown in FIG. 1, the sequence of treatment steps (shown as zones) for converting a coal product to a stabilized coal-oil mixture in accordance with the present invention, includes: an elevated temperature mixing and reaction zone 10; an elevated temperature high shearing zone 12, and a gelling zone 14. These zones can collectively be referred to as the coal-oil mixture forming section, represented by the numeral 16. In FIG. 2, the sequence of treatment steps is shown with reference to an overall process for converting raw coal into a stabilized coal-oil mixture in accordance with the invention.

Thus, referring specifically to FIG. 2, the process of the invention for converting raw coal into a stabilized coal-oil mixture includes: a pulverization zone 18, a chemical surface treatment and separation zone 20, a drying zone 24 and a coal-oil mixture forming section 16, comprised of, as mentioned previously, the elevated temperature mixing and reaction zone 10, the elevated temperature high shearing zone 12 and the gelling zone 14.

In the above-referred to copending U.S. patent applications Ser. Nos., 114,357 and 114,414, a technique for treating raw coal in pulverization zone 18, chemical surface treatment and separation zone 20 and drying zone 24, is described. These disclosures are hereby incorporated herein by reference. In addition, in the above-referred to Government Report No. 2694, titled, "Fuel Extension by Dispersion of Clean Coal in Fuel Oil" the technique is further described. That disclosure is also hereby incorporated herein by reference.

Referring now to the treatment in each of the various zones, it is first desired to reduce raw coal to a relatively fine diameter size and to remove the unwanted rock, heavy ash and like materials collected in the mining operation. Thus, as shown in FIG. 2, raw coal such as anthracite, bituminous coal, sub-bituminous coal, lignite and the like, is introduced into pulverization zone 18 through line 26 wherein the raw coal is crushed and initially cleaned, usually in the presence of water, using conventional apparatus, such as ball mills, breakers and the like. At this point, it is generally desirable to introduce additives, such as sodium pyrophosphate or sodium carbonate which assist in rendering the ash more hydrophilic to facilitate separation for reasons that will be immediately apparent. Such additives are shown in FIG. 2 to be introduced through line 29. The water utilized during the pulverization operation is shown in the drawing to be introduced through line 28. Rock and other unwanted products are removed from pulverization zone 18 through line 30.

The coal-water stream produced in pulverization zone 18 is typically in a coal to water ratio of about 1 to 19, preferably about 1:3, in the form of an aqueous slurry, the coal having a particle mesh size of approximately 48 to 300 mesh, preferably about 80% being of about 200 mesh Tyler Standard screen size. At this point unwanted ash and sulfur are still present in the coal, and it is desired to chemically treat the coal to facilitate the separation of coal from the ash and sulfur in a unitary or nearly unitary operation as will be discussed.

Thus, the coal-water slurry leaving pulverization zone 18 through line 32 is introduced into chemical surface treatment and separation zone 20 wherein the coal is chemically treated and separated from the ash and sulfur. In this zone the coal is treated with monomeric compound in the presence of a liquid organic carrier, water and selected additives such as, reaction initiators and catalysts. The coal thus treated is adapted to ready separation from ash and sulfur, preferably by oil and water separation techniques, because the additives employed make the treated coal hydrophobic and olephilic, thus facilitating coal separation from ash and sulfur, which are generally hydrophilic.

The process of the invention utilizes two stages of "chemical surface treatment". First, chemical surface treatment is undertaken in chemical surface treatment and separation zone 20, wherein raw coal is cleaned i.e., beneficiated. The second chemical surface treatment occurs in elevated temperature mixing and reaction zone 10, which is employed in forming the coal-oil mixture. The chemical surface treatment process used in the process herein is disclosed in great detail in heretofore-mentioned copending U.S. applications Ser. No. 114,414 and Ser. No. 114,357. While it is not completely understood at this time and while not wishing to be bound by theory, it is believed that this surface treatment involves the formation of a polymeric organic coating on the surface of the coal of one or more monomeric units by molecular grafting or otherwise, of polymeric side chains on the coal molecules.

The chemical surface treatment materials include: "monomeric compound"; "reaction initiator"; "reaction catalyst" and "liquid organic carrier", adapted for use in one or both of these two zones. The particular compounds used in each zone can differ.

The following will describe the "monomeric compound"; "reaction catalyst"; "reaction initiator", and "liquid organic carrier" adapted for use in the two chemical surface treatments of the invention.

As used herein the term "monomeric compound" connotes a wide range of entities adapted to treat the coal. Any polymerizable monomer can be employed. While it is more convenient to utilize monomers which are liquid at ambient temperature and pressure, gaseous monomers which contain olefinic unsaturation permitting polymerization with the same or different molecules can also be used. Thus, monomers intended to be employed herein may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, vinylbromide, acrylonitrile, methacrylonitrile, acrylamide, methacrylamide, N-methylolacrylamide, acrolein, maleic anhydride, maleic acid, fumaric acid, abietic acid, mixtures thereof and the like.

A preferred class of monomers for the purposes of the present invention are unsaturated carboxylic acids, esters, or salts thereof, particularly, those included within the formul $$RC(=O)-OR'$$

wherein R is an olefinically unsaturated organic radical, preferably containing from about 2 to about 30 carbon atoms, and R' is hydrogen, a salt-forming cation such as an alkali metal, alkaline earth metal or ammonium cation, or a saturated or ethylenically unsaturated hydrocarbyl radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di- and tri-glycerides of one or more unsaturated fatty acids and other esters of unsaturated fatty acids, acrylic acid, methacrylic acid, methyl acrylate, ethylacrylate, ethylhexylacrylate, tertiarbutyl acrylate, oleylacrylate, methylmethacrylate, oleylmethacrylate, stearylacrylate, stearylmethacrylate, laurylmethacrylate, vinylstearate, vinymyristate, vinyllaurate, soybean oil, dehydrated castor oil, tall oil, corn oil and the like. For the purposes of this invention, tall oil and corn oil have been found to provide particularly advantageous results. Corn oil is especially preferred. Thus, it is clearly understood that compositions containing compounds within the foregoing formula and in addition containing, for example, saturated fatty acids such as palmitic, stearic, etc. are also contemplated herein.

The term "chemical surface treatment agent" connotes a wide range of compounds and entities adapted for use in the invention. The term chemical surface treatment agent includes reaction initiators, reaction catalysts, combinations of reaction initiators and reaction catalysts and combinations of reaction initiators and combinations of reaction catalysts.

"Reaction initiator" connotes a wide range of compounds known to initiate free radical reactions. For the purposes herein, any of those disclosed in the prior art may be used. Specifically, some of these initiators include, for example, sodium perchlorate and perborate, sodium persulfate, potassium persulfate, ammonium persulfate, silver nitrate, water soluble salts of noble metals such as platinum and gold, and water soluble salts of iron, zinc, arsenic, antimony, tin and cadmium and combinations of these materials. Particularly preferred initiators herein are the water soluble copper salts, i.e. cuprous and cupric salts, such as copper acetate, copper sulfate and copper nitrate. Most advantageous results have been obtained herein with curic nitrate, $Cu(NO_3)_2$. Further initiators contemplated herein are also disclosed in U.S. patent application Ser. No. 230,063 filed concurrently herewith and incorporated herein by reference. These initiators include metal salts of naphthenates, tallates, octanoates, etc. said metals including copper, cobalt, chromium, mercury, mnganese, nickel, tin, lead, zinc, iron, rare earth metals and mixed rare earths.

The "reaction catalyst" employed in the coal surface treating reaction are any such materials commonly used in polymerization reactions. Typically, for the purposes of this invention, any catalytic amount of those catalysts, which are commonly referred to as free radical catalysts or catalyst system (which can also be referred to as addition polymerization catalysts, vinyl polymerization catalysts or polymerization initiators) are preferred. Thus, illustratively, catalysts contemplated herein include benzoyl peroxide, methylethyl ketone peroxide, tertbutylhydroperoxide, hydrogen peroxide, ammonium persulfate, di-tert-butylperoxide, tert-butylperbenzoate, peracetic acid and, including such nonperoxy free radical initiators as the diazo compounds, such as 1-bis-azo-isobutyro nitrile and the like.

The surface treating reaction mixture of the present invention also includes a liquid organic carrier. This liquid organic carrier is utilized to facilitate contact of the surface of the coal particles with the reactants. Thus, liquid organic carriers included within the scope of this invention are, for example, fuel oil, such as No. 2 or No. 6 fuel oils, other hydrocarbons including benzene, toluene, xylene, hydrocarbons fractions such as naphtha and medium boiling petroleum fractions (boiling point 100°-180° C.), dimethylformamide, tetrahydrofurane, tetrahydrofurfuryl alcohol, dimethylsulfoxide, methanol, ethanol, isopropyl alcohol, acetone, methylethyl ketone, ethyl acetate and the like and mixtures thereof. For the purposes of this invention, fuel oil is a preferred carrier.

Treatment in chemical surface treatment and separation zone 20 utilizes vigorous admixing of the coal slurry and reactants such as by mixing, injection, spraying or pumping action, to cause agitation, aeration and froth in the mixture. The sequence for admixing the coal slurry, oil, water, monomeric compound, reaction initiator and reaction catalyst can be varied. However, it is generally desirable to introduce the coal-water slurry into a mixture of liquid organic carrier, monomeric compound and cleaning water, followed by the introduction of reaction catalyst and the reaction initiator.

As seen in FIG. 2, the pulverized coal-water slurry is introduced into chemical surface treatment and separation zone 20 through line 32 where it is contacted with the monomeric compound introduced through line 34; reaction catalyst introduced through line 36; reaction initiator introduced through line 38; organic liquid carrier introduced though line 40 and cleaning water introduced through line 48. The first chemical surface treatment reaction occurs in this zone during the admixing of the materials and the coal particles are made hydrophobic and oleophilic.

The hydrophobic and oleophilic characteristics of the treated coal are utilized to separate the coal from the unwanted ash and sulfur, which are both normally hydrophilic. This is readily effected utilizing the tendency of the ash and sulfur to enter the water phase. In this manner, the coal can be separated from the ash and sulfur by conventional operations adapted to separate oil from water.

A particularly effective technique for separating the treated coal particles from the unwanted ash and sulfur in the water phase is an aeration spray method wherein a coal froth phase is formed by spraying or injecting the treated or untreated coal-water slurry into the surface of cleaning water as is described in U.S. patent application Ser. Nos. 230,058 and 230,059 filed concurrently herewith and incorporated herein by reference. Briefly, according to the methods there described the coal slurry is injected through spray nozzles at a spaced-apart distance from the water surface into the water surface to form a turbulent region producing aeration and a frothing or foaming of the coal particles.

Referring again to FIG. 2, into chemical surface treatment and separation zone 20 is introduced the reactants into one or more froth flotation units. The reactants can be separately introduced into the froth flotation units or they can be admixed beforehand in lines leading to the units. The coal-water slurry is introduced into the vessel through pressure nozzles which facilitate the separation of ash from the coal by assisting in breaking up flocs of coal which are formed during chemical treatment. In the units being described, a froth phase ensues, which rises to the surface of the water in the froth flotation unit carrying the cleaned coal with it. The coal froth can then be skimmed from the water surface to effect the separation of the coal from ash and sulfur, which remain in the cleaning water.

It will be seen therefore that the "chemical surface treatment" method offers considerable advantage in that the chemical reaction is made to occur simultaneously with the separation of the ash and sulfur. As a further advantage, a greater amount of ash and sulfur separation is achieved because the coal is treated in a fine size. Generally, admixing such fine size coal in the presence of water would seriously devalue the Btu content of the coal. The chemical surface treatment method, however, provides a ready separation from water and therefore maintains the high Btu value of the coal.

Figure 3:
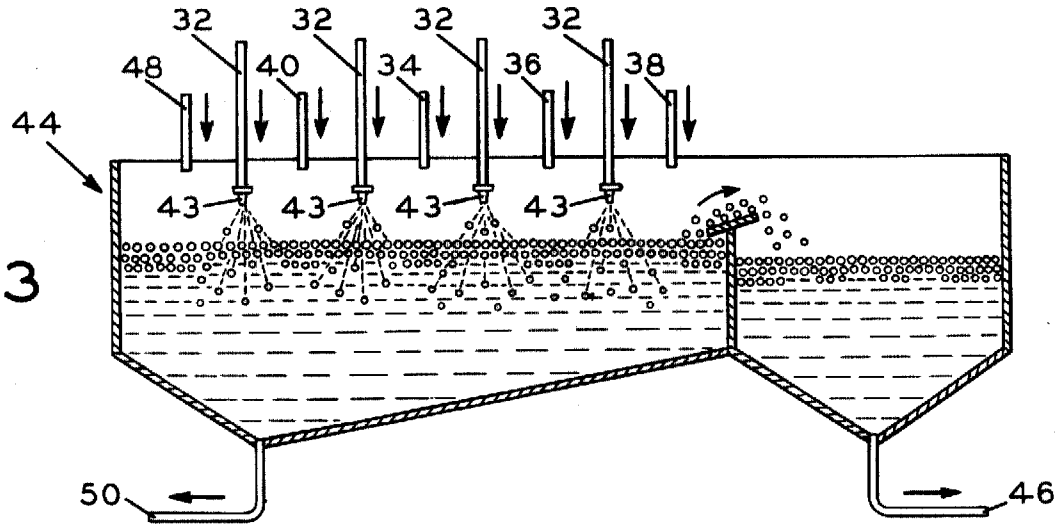
FIG. 3 is an illustration of a vessel utilized in chemical surface treatment and separation zone 20.

FIG. 3 illustrates one unit 44 suitable for use in chemical surface treatment and separation zone 20. The coal slurry enters the unit 44 through lins 32, through nozzles 43. Cleaning water enters through line 48 and reaction initiator, reaction catalyst, monomeric compound and liquid organic carrier enter through lines 38, 36, 34 and 40, respectively. Frothing takes place, thus providing a coal froth phase and a water phase. The coal froth phase is skimmed from the water surface and removed through line 46. The procedure in froth flotation unit 44 can be repeated (preferably about two further times) until a cleaned coal stream is formed. It may not be necessary to repeat the chemical surface treatment in any repeated froth flotation steps.

The reaction conditions utilized in vessel 44 will vary depending on the materials employed. Generally the unit is operated at temperatures of from 20° to 90° F. and at atmospheric or nearly atmospheric pressure.

It is now desired that the coal, cleaned in chemical surface treatment and separation zone 20, be dried or substantially dried. It has been generally considered that coal having too high a water content would be unsuited to the formation of stable coal-oil mixtures. Excess water has been considered to seriously impare the gelling operation needed to form the stable coal-oil mixture. Advantageously, according to the present invention, the amount of drying required for the water ladened coal is significantly reduced by virtue of a unique coal-oil mixture forming technique. In this way, less energy is needed to dry the coal and the need for burdensome and expensive drying units is substantially reduced. Moreover, as indicated previously, the treated coal is now hydrophobic and oleophilic making drying even less burdensome. Drying can therefore be readily effected using conventional mechanical dryers, and not expensive and time consuming thermal dryers. All of these features making the process of the invention even more attractive.

Thus, referring again to FIG. 2, the cleaned coal is removed from chemical surface treatment and separation zone 22 through line 46 and is introduced into drying zone 24 to remove the excess water.

The apparatus utilized in drying zone 24 are readily available and can include conventional centrifugal driers, vacuum driers and the like.

Up to this point the foregoing described procedures and/or techniques are generally described in patent applications Ser. Nos. 114,357, 114,414 and in patent applications, except for the amount of drying and the amount of equipment in the drying zone as alluded to previously. Such reduced drying time and equipment is possible by the procedural steps discovered herein.

Thus, the treated coal leaving drying zone 24 and having a water content of approximately 15%, based on the weight of dry coal, is then introduced into the coal-oil mixture forming section 16.

Surprisingly, applicant has found that subjecting the treated coal in first and second treating zones wherein the coal can again be subjected to chemical surface treatment and is admixed with oil under selected conditions of temperature and shear or mixing, provides a stable coil-oil mixture which permits the use of coal having a substantially high water content and which requires a reduced amount of reactants to obtain satisfactory results.

In the first step, it is desired to admix the coal with oil to form the coal-oil mixture, and preferably to again chemically surface treat the coal. This is effected under conditions of elevated temperature and low shear or mixing. In the second step, the coal-oil mixture is immediately subjected to a condition of high shear or mixing at the maintained elevated temperature.

Thus, as seen in FIG. 2, the dry coal leaving drying zone 24, which as a result of treatment is in powder form, is introduced into elevated temperature and reaction zone 10, through line 52, where it is admixed in a suitable mixing vessel (not shown) with oil introduced through line 54. The amount of coal in the admixture can vary from 5% by weight coal to 70% by weight. Preferably the coal is admixed in an amount of about 50% by weight. Monomeric compound introduced through line 56, reaction initiator introduced through line 58 and reaction catalyst introduced through line 60 are added to the coal-oil mixture at this point.

The reactants, including the monomeric compound, reaction initiator, and reaction catalyst, utilized in elevated temperature and reaction zone 10 are the same type as those utilized in chemical surface treatment and separation zone 20, and have been described previously. The preferred reactants for use in elevated temperature and reaction zone 10, include tall oil as the monomeric compound; a solution of benzoyl peroxide in toluene as the reaction catalyst; a solution of cupric nitrate in water as the reaction initiator; and No. 2 fuel oil as the oil used in major amounts to form the coal-oil mixture. The proportions of each of these materials can vary. Typically, for approximately a 50:50 coal-oil mixture, the amounts of materials used are approximately, by weight, about 5 to 1000 parts per million (ppm) preferably 5–10 ppm of reaction initiator; and about 2.5 to 500 parts per million (ppm) preferably 2.5–5; ppm of reaction catalyst.

The monomeric compound is utilized in zone 10, according to the invention, in very low amounts of from about 0.2% to about 5%, preferably about 1.0 to about 3%, based on the total weight of the coal-oil mixture.

The procedure for admixture of the reactants can vary. In one technique the monomeric compound is first admixed with the oil. Reaction initiator is then introduced, followed by the addition of reaction catalyst. Alternatively, all of the reactants can be admixed in one step.

Admixture of the reactants in elevated temperature and reaction zone 10 is conducted at elevated temperatures and under conditions of low shear.

As used herein the term "low shear" connotes a general admixture of components under conditions suitable for thorough contacting of the constituents. The condition of low shear utilized in this zone is generally less than 1000 reciprocal seconds.

As used herein, the term "high shear", connotes the vigorous admixture, turbulent mixing, mixing or high agitation of coal-oil mixtures. Generally, the condition of high hear is greater than 1000 reciprocal seconds and preferably greater than 4500 reciprocal seconds.

As used herein, the term "elevated temperature" refers to temperatures from about 145° to 195° F., and more preferably from 175° to 190° F.

The time period for mixing in elevated temperature mixing and reaction zone can vary. Generally, admixing is done in a period of from about 10 seconds to about 30 minutes and preferably from about 30 to 60 seconds, although the invention is adapted to both steady state and batch operations so that the residence time can vary widely.

A wide variety of apparatus can be used in elevated temperature and reaction zone 10. One suitable apparatus is a stainless steel vessel having associated stirring means and a steam heated jacket.

It is now desirable to subject the mixture to a condition of high shear. As indicated previously, it is believed that this combined treatment facilitates the gelling operation, permitting the presence of more water and the use of less monomeric compound.

Thus, again referring to FIG. 2, the coal-oil mixture leaves elevated temperature mixing and reaction zone 10 through line 62 and is introduced into elevated temperature high shearing zone 12. In this zone, a high shearing apparatus is employed to admix the coal-oil mixture at the desired elevated temperatures of from about 145° to 195° F., preferably 175°–190° F., and at high shearing. One high shearing apparatus suitable for use in zone 12 is the "Dicon" mixer available from the W. H. Potter Co., Model No. 3MS5.0004.

Generally, it is preferable that the high shear mixing in zone 12 immediately follow the low shear mixing in zone 10 so little time, if any, is provided for the coal to settle in the coal-oil mixture. The period for high shear mixing in zone 12 will vary. But generally, high shear mixing is done in periods of from about 10 seconds to about 30 minutes and preferably about 60 to 90 seconds, although the invention is adapted to both steady state or batch operations so that the residence times can vary widely.

It is now desired to stabilize the highly sheared coal-oil mixture. As indicated above a gelling agent can be employed for this purpose. Advantageously, it is believed that by virtue of the chemical surface treatment, the gelling agent uniquely combines with the dispersed coal, making the mixture even more stable and the possibility of coal settling even less likely.

Thus, referring again to FIG. 2, the highly sheared coal-oil mixture leaves elevated temperature high shearing zone 12 through line 64 and is introduced into gelling zone 14 where selected gelling agents are added to form the stable coal-oil mixture in the form of a gel or thixotropic mixture.

A wide variety of gelling agents can be used in gelling zone 14 and include: organic and inorganic bases, such as sodium hydroxide, calcium hydroxide, potassium hydroxide, ammonium hydroxide and the like. The preferred gelling agent for use in gelling zone 14 is sodium hydroxide, preferably diluted in water to a 33% concentration. These materials can be added as such, or in the form of aqueous solution.

To avoid undue "seeding out" of the water still present in the coal-oil mixture, the gelling agent is gradually added to the mixture.

After the required time for gelling, (i.e., forming the gel or thixotropic mixture), the gelled coal-oil mixture is withdrawn as a product from gelling zone 14 through line 68 as a highly stable coal-oil mixture, having excellent non-settling properties and a high Btu burning capacity. The mixture is useable in this form or it can be subjected to further treatment such as shearing to maintain a uniform coal distribution in the mixture. The resulting mixture is stable, thixotropic and gel like, yet it is readily flowing upon subjection to shearing or pumping forces.

The following examples will further illustrate the invention.

In the Examples, Examples 1-3, generally show the process steps for producing particular types of treated coal product suitable for forming the coal-oil mixtures according to the invention although other treated or untreated coals can be used. In general, the procedures of Examples 1-3 follow the process steps in FIG. 2, beginning with the pulverization treatment and up to the elevated temperature mixing and reaction zone 10.

EXAMPLE 1

200 grams of Pittsburgh Seam coal having 6.3% ash content is pulverized in the presence of water to a 200 mesh size using a ball mill grinding unit. Rock is removed and the coal is then transferred to a mixing vessel. Into this unit is also introduced 0.030 grams of corn oil, 5.0 grams of #2 fuel oil, 1.0 cubic centimeters of a 5% solution of hydrogen peroxide in water; 2.0 cubic centimeters of a 5% solution of cupric nitrate in water and 200 grams of the 200 mesh coal. The mixture is stirred and heated to 86° F. for 2 minutes. The mixture is sprayed into the surface of a slurry and a frothing ensues. Coal, in the froth phase, is skimmed from the surface of the water. The water phase containing large amounts of the hydrophilic ash and sulfur is discarded.

The cleaning procedure is repeated two further times using cleaning water and skimming the frothed coal from the water surface. The coal is then dried to a water content of 15.4%, based on the weight of dry coal, using a Büchner filter.

EXAMPLE 2

The procedure of Example 1 is repeated using equivalent amounts of (a) styrene monomer; (b) oleic acid; and (c) dicyclopentadiene; substituted for corn oil. A cleaned coal product is produced having a moisture concentration of 15% based on the weight of dry coal.

EXAMPLE 3

The procedure of Example 1 is repeated using (a) Pocohontas coal; (b) Taggart coal and (c) Lower Freeport coal substituted for Pittsburgh Seam coal. A cleaned coal product is produced having a moisture concentration of 20% based on the weight of dry coal.

EXAMPLE 4

The teachings of the invention are employed.

In a 1.8 liter stainless steel beaker equipped with magnetic stirrer and heating element is added: 200 cubic centimeters of #2 fuel oil and 6 grams of tall oil (i.e., 1.5% tall oil, based on the weight of dry coal and oil). The mixture is heated to 190° F. To the mixture is added 235 grams of the cleaned coal produced in accordance with the procedure in Example 1 (moisture content of 15%, based on the weight of dry coal). The mixture is again stirred and heated to maintain the temperature at about 190° F. The coal-oil mixture is then transferred to a Waring blender, Model No. 31BL92, having a "low" speed range and a "high" speed range. The mixture is stirred at the "low" speed range for 30 seconds. During the 30 second period two cubic centimeters of a 0.1% solution of a cupric nitrate in water solution and one cubic centimeter of a benzoyl peroxide (0.1%) in toluene solution are added to the mixture. After the 30 second period, the solution is mixed in the Waring blender at the "high" speed rate for a period of 60 seconds.

The mixture is then transferred to a stainless steel vessel fitted with a mixer and a heating element. The mixture is slowly stirred and maintained at a temperature of 190° F. While stirring, to the mixture is added 3.8 cubic centimeters of a 33% sodium hydroxide solution in water over a 15 second period using a laboratory buret. Stirring of the mixture is continued for a 1.5 minute period.

It is observed during the 1.5 minute period that the coal-oil mixture first thickens, then thins, and then thickens to a stabilized coal-oil mixture. Upon observation, the mixture remains as a thickened gel after stirring ceases.

EXAMPLE 5

The procedure of Example 4 is repeated utilizing oleic acid and linoleic acid in equivalent amounts in substitution for tall oil.

A stable coal-oil mixture is produced each time.

EXAMPLE 6

The procedure of Example 4 is repeated except that an equivalent amount of hydrogen peroxide is utilized in substitution for benzoyl peroxide as the reaction catalyst.

A stable coal-oil mixture is produced eath time.

From the foregoing, it will be seen that the technique of the present invention provides stable coal-oil mixtures using coals having a water content 15% or higher.

It will be understood that the technique of the present invention can be adapted to a wide range of materials and reactants, making the process more versatile and even further attractive. For example, coals unbeneficiated or treated by the variety of conventional cleaning techniques can be introduced directly into the elevated temperature mixing and reaction zone 10 for the formation of the stable coal-oil mixture.

One skilled in the art can appreciate that in practicing the technique of the present invention, wherein distinct areas of treatment are described as zones, particular treatment steps may occur outside of the distinct zones described or there may be overlapping between the treatment in the separate zones without departing from the invention.

Thus, while I have fully described an embodiment of the foregoing invention, it is to be understood that this description is offered by way of illustration only. The range of adaptability of the process presented herein is contemplated to include many variations and adaptations of the subject matter within the scope of the production of stable coal-oil mixtures, and it is to be understood that this invention is to be limited only by the scope of the appended claims.

What is claimed is:

1. A method for forming a stabilized coal-oil mixture, comprising:

(a) admixing a coal with an oil, a monomeric compound and at least one chemical surface treatment agent to form a coal-oil mixture;

(b) heating said coal-oil mixture to an elevated temperature;

(c) subjecting said coal-oil mixture to a condition of low shear at said elevated temperature to form a low sheared coal-oil mixture;

(d) subjecting said low sheared coal-oil mixture to a condition of high shear to form a high sheared coal-oil mixture; and (e) admixing at least one gelling agent into said coal-oil mixture to form a stabilized coal-oil mixture.

2. The method of claim 1 wherein said elevated temperature in step (b) is between about 145° and 195° F.

3. The method of claim 1 wherein in step (c) said condition of low shear is less than about 1000 reciprocal seconds.

4. The method of claim 1 wherein in step (d) said condition of high shear is greater than about 1000 reciprocal seconds.

5. The method of claim 1 wherein said coal admixed in step (a) is a treated coal formed by the reaction of a second monomeric compound with a raw coal in the presence of at least one second chemical surface treatment agent and a liquid organic carrier.

6. The method of claim 1 wherein said monomeric compound is added in step (a) in an amount of from about 0.2% to about 5%, based on the total weight of the coal-oil mixture.

7. The method of claim 1 wherein said monomeric compound is added in step (a) in an amount of from about 1.0% to about 3%, based on the total weight of the coal-oil mixture.

8. A method for forming a stabilized coal-oil mixture, comprising:

(a) admixing a treated coal product with an oil, a monomeric compound and at least one chemical surface treatment agent to form a coal-oil mixture, said treated coal product being formed by the reaction of a second monomeric compound with a raw coal in the presence of at least one second chemical surface treatment agent and a liquid organic carrier, in the presence of an aqueous medium;

(b) heating said coal-oil mixture to an elevated temperature;

(c) subjecting said coal-oil mixture to a condition of low shear at said elevated temperature to form a low sheared coal-oil mixture;

(d) subjecting said low sheared coal-oil mixture to a condition of high shear to form a high sheared coal-oil mixture; and (e) admixing at least one gelling agent into said coal-oil mixture to form a stabilized coal-oil mixture.

9. A method according to claim 1 wherein said coal in said coal-oil mixture is in an amount of about 50 percent by weight, based on the weight of the mixture.

10. A method according to claim 1 wherein said chemical surface treatment agent is a reaction catalyst comprising hydrogen peroxide or benzoyl peroxide.

11. A method according to claim 1 wherein said chemical surface treatment agent is a reaction initiator selected from the group consisting essentially of cupric nitrate, cobalt nitrate, cubric naphthenate and cobalt naphthenate.

12. The method of claim 1 wherein said condition of high shear in step (d) is made to occur immediately following said condition of low shear in step (c).

13. A method according to claim 1 wherein said monomeric compound is an unsaturated organic compound.

14. A method according to claim 13 wherein said unsaturated organic compound is a monomer comprised of a compound having the formula $$RC(=O)-OR'$$

wherein R is an olefinically unsaturated organic radical, and R′ is selected from the group consisting of hydrogen, a salt forming cation, a saturated or ethylenically unsaturated hydrocarbyl radical, said hydrocarbyl radical being unsubstituted or substituted with one or more members selected from the group consisting of halogen, carboxylic acid groups, hydroxyl groups, and hydroxyl groups in which the hydroxyl hydrogen atom is replaced with a saturated or unsaturated acyl group or a combination of saturated and unsaturated acyl groups, and said surface treatment agent is comprised of a free radical catalyst and a free radical initiator.

15. A method according to claim 14 wherein said monomeric compound is tall oil.

16. The method according to claim 1 wherein a liquid organic carrier is added in step (a).

17. A method according to claim 16 wherein said liquid organic carrier is selected from the group consisting essentially of #2 fuel oil and #6 fuel oil.

18. A method according to claim 1 wherein said gelling agent is a base.

19. A method according to claim 18 wherein said base is selected from the group consisting of sodium hydroxide, calcium hydroxide and potassium hydroxide.

20. A method for forming a stabilized coal-oil mixture, comprising:

(a) admixing a coal product with a fuel oil, tall oil, benzoyl peroxide and cupric nitrate to form a coal-oil mixture;

(b) heating said coal-oil mixture to about 175° to 190° F.;

(c) subjecting said coal-oil mixture to a condition of low shear at said elevated temperature to form a low sheared coal-oil mixture;

(d) subjecting said low sheared coal-oil mixture to a condition of high shear at said elevated temperature to form a high sheared coal-oil mixture; and (e) admixing said high sheared coal-oil mixture with a hydrogen peroxide to form a stabilized coal-oil mixture.

21. A method for forming coal-oil mixture comprising:

(a) introducing a raw coal into a pulverization zone to form a pulverized coal;

(b) introducing said pulverized coal to a chemical surface treatment and separation zone wherein said pulverized coal is reacted with a first monomeric compound, a first reaction initiator and a first reaction catalyst, and a liquid organic carrier in the presence of an aqueous medium and is separated from ash and sulfur to form a cleaned coal stream;

(c) introducing said cleaned coal stream into a drying zone wherein a powdered coal stream is formed;

(d) admixing said powdered coal stream of step (c) with a liquid organic carrier, a second monomeric compound, a second reaction catalyst, and a second reaction initiator to form a coal-oil mixture;

(e) heating said coal-oil mixture to an elevated temperature;

(f) subjecting said coal-oil mixture to a condition of low shear at said elevated temperature to form a low sheared coal-oil mixture;

(g) subjecting said low sheared coal-oil mixture to a condition of high shear to form a high sheared coal-oil mixture; and (h) admixing at least one gelling agent into said high sheared coal-oil mixture to form a stabilized coal-oil mixture.

22. The method of claim 21 wherein in step (b) said monomeric compound is corn oil; said reaction initiator is cupric nitrate; said reaction catalyst is benzoyl peroxide and said liquid organic carrier is #2 fuel oil.

23. The method of claim 21 wherein in step (d) said second monomeric compound is tall oil, said second reaction initiator is benzoyl peroxide, and said second reaction catalyst is cupric nitrate.

24. A stabilized coal-oil mixture comprising:

(a) a coal product formed by treating coal in a pulverization zone, a chemical surface treatment and separation zone and a drying zone;

(b) an oil product admixed with said coal product, in the presence of a monomeric compound, a reaction initiator and a reaction catalyst; and (c) a gelling agent.

25. A stabilized coal-oil mixture resulting from the process of claim 1.

26. A stabilized coal-oil mixture resulting from the process of claim 20.

27. A stabilized coal-oil mixture resulting from the process of claim 21.

* * * * *